United States Patent [19]

McCosker

[11] 4,038,979

[45] Aug. 2, 1977

[54] SANITARY FACE MASK

[76] Inventor: Doris C. McCosker, 9206 Winchester Ave., Margate, N.J. 08402

[21] Appl. No.: 608,395

[22] Filed: Aug. 27, 1975

Related U.S. Application Data

[63] Continuation-in-part of Ser. No. 338,208, March 5, 1973, Pat. No. 3,908,648, which is a continuation-in-part of Ser. No. 210,962, Dec. 22, 1971, Pat. No. 3,740,768.

[51] Int. Cl.[2] ..... A61F 9/00; A61M 15/00

[52] U.S. Cl. ..... 128/141 R; 128/146.6; 2/9; 132/1 R

[58] Field of Search ..... 128/132 R, 139, 140 R, 128/141 R, 142.5, 142.6, 142.7, 145 R, 146–147, 205, 195; 2/9 R; 132/1 R

[56] References Cited

U.S. PATENT DOCUMENTS

| | | | |
|---|---|---|---|
| 1,359,073 | 11/1920 | King et al. | 128/146.6 |
| 3,186,005 | 6/1965 | Gentile | 128/141 R |
| 3,772,707 | 11/1973 | Alosi et al. | 2/9 R |
| 3,789,428 | 2/1974 | Martin | 2/9 R |
| 3,918,448 | 11/1975 | McCosker | 128/146.6 |

FOREIGN PATENT DOCUMENTS

| | | | |
|---|---|---|---|
| 348,733 | 5/1937 | Italy | 128/141 R |

*Primary Examiner*—Robert W. Michell
*Assistant Examiner*—Henry J. Recla
*Attorney, Agent, or Firm*—Benasutti Associates, Ltd.

[57] ABSTRACT

In one embodiment of the present invention, a frame defining a face mask is disclosed having a flexible transparent disposable filter material removably retained about the frame. Another embodiment of the present invention discloses an elastomeric frame which tapers to a feathered edge at the periphery intended to contact the face, said elastomeric frame engaging a transparent facial insert, which insert includes means for removably retaining filter material. The mask is further provided with a disposable sanitary perforated bag-shaped web which envelops the frame and transparent facial insert to protect the exposed surfaces thereof from contamination while allowing the user to breathe freely.

3 Claims, 15 Drawing Figures

Fig. 8
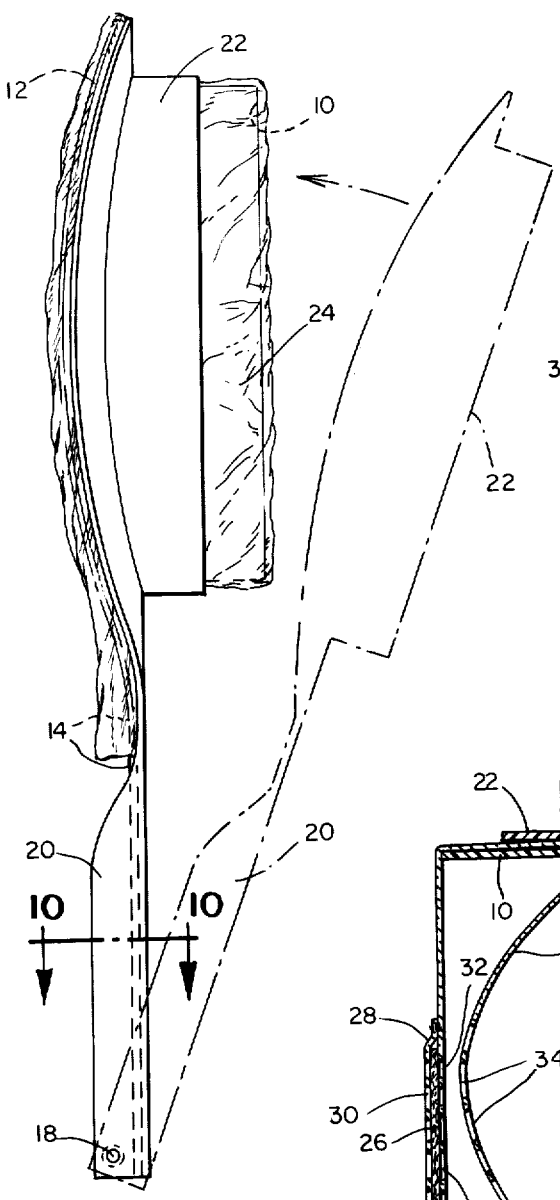
Fig. 7
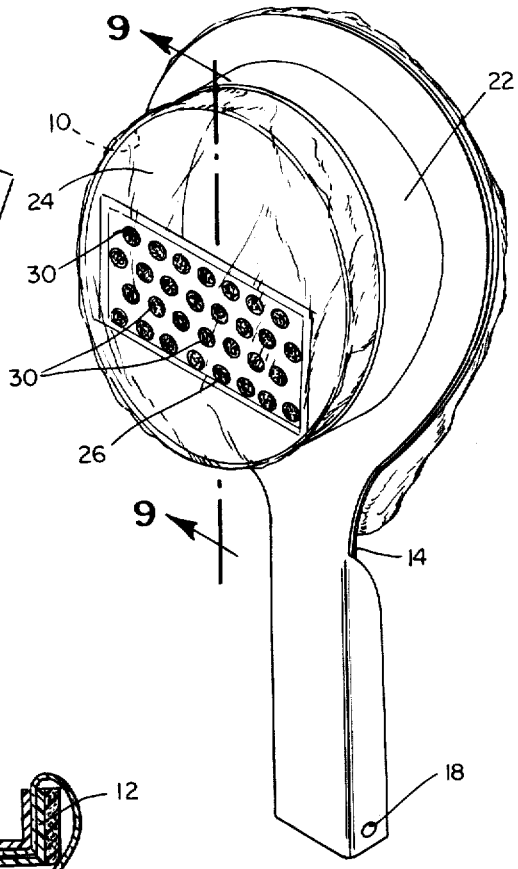
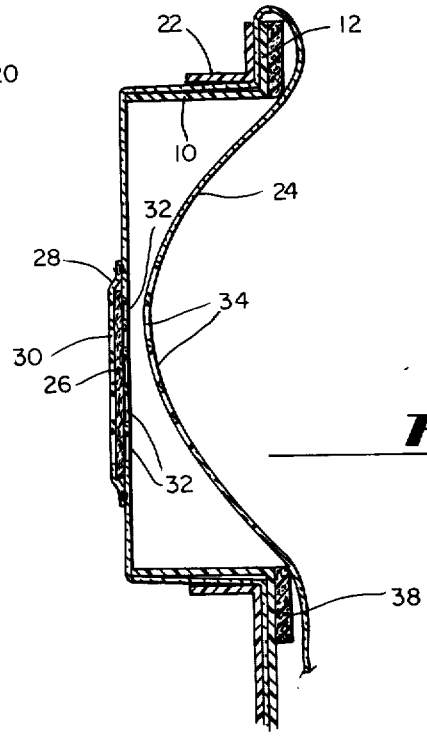
Fig. 9
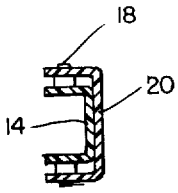
Fig. 10

Fig. 13
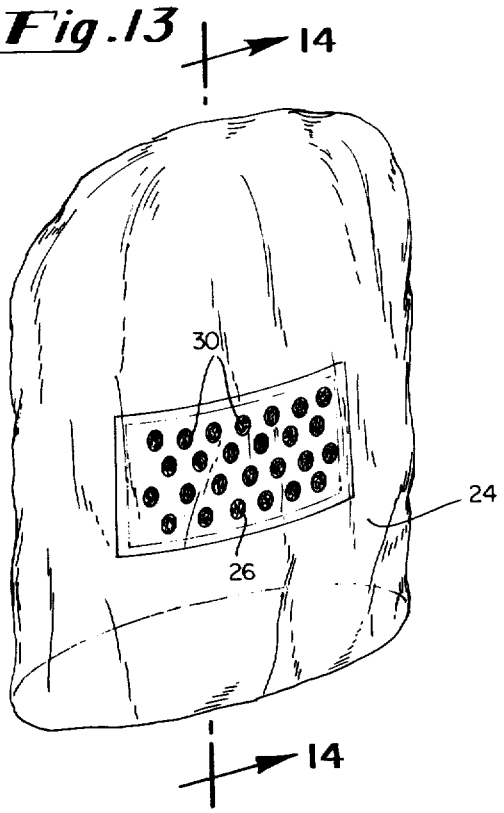
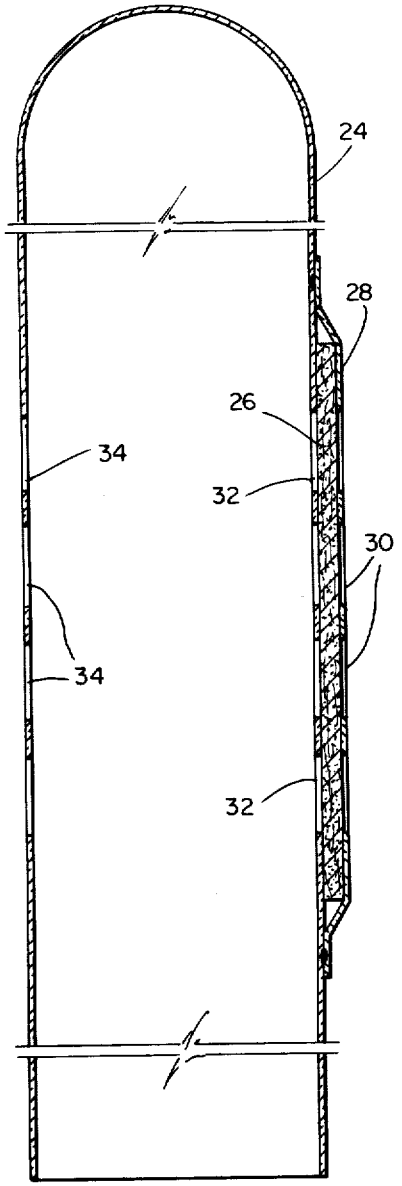
Fig. 14
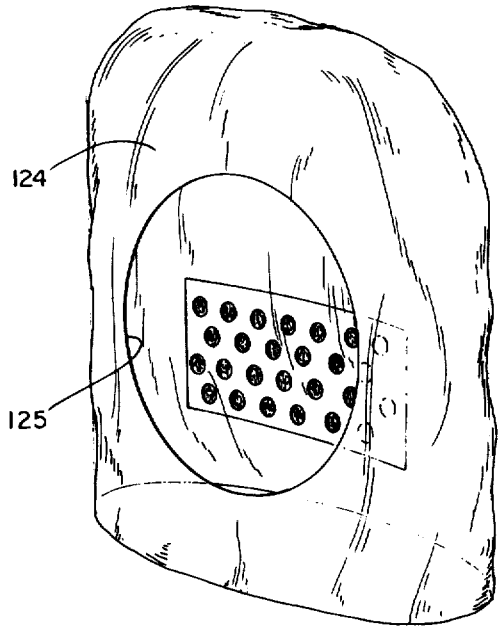
Fig. 15

SANITARY FACE MASK

CROSS-REFERENCE TO RELATED APPLICATIONS

This application is a continuation-in-part of my prior copending application Ser. No. 338,208, filed Mar. 5, 1973, now U.S. Pat. No. 3,908,648, which is a continuation-in-part application of my prior copending application Ser. No. 210,962, filed Dec. 22, 1971, now U.S. Pat. No. 3,740,768, and this application incorporates by reference each of the disclosures of the above-identified applications.

BACKGROUND OF THE INVENTION

This invention relates to a device used to protect the face of an individual and to aid in preventing the inhalation of toxic air during spraying, such as when spraying ingredients from an aerosol container during the application of hair spray, or in spraying room deodorants, insecticides, paint, and the like. In particular, the application pertains to a device which is provided with a disposable sanitary closest to the face of the individual.

In the prior art, face shields and masks are known for use during the application of hair sprays. See, for example, the device shown in U.S. Patent D-210,183. In general, it is known to provide a mask which has the outlines or contours of a face and which will fit against the forehead, under the chin and around the perimeter of the face, and which can be held in place by a handle or strap, as desired. See, for example, U.S. Pats. Nos. 825,288, 1,524,863, 3,015,105, 3,060,445, 3,103,667, 3,152,588, 3,317,921 and 3,488,772. This art shows various means for permitting an individual to breathe while using a mask. Further, it is known to use a transparent material to cover the face during the application of hair spray. A problem with these prior art devices is that they are basically unsanitary.

SUMMARY OF THE INVENTION

I have overcome the deficiencies of the prior art in one of the embodiments of the present invention by providing a frame in a generally hollow semi-ovoid shape, along that portion of the frame which is in closest proximity to the face of the person utilizing the device during spraying.

In various variations of this embodiment both the frame and filter material structure are modified to provide additional desirable end results. In one such embodiment, I have provided a handle extending from the frame to form a manual support means and, in another embodiment, I have provided a strap on the frame so that the frame can be held against the face of the user.

Separate retaining means are also provided so that the filter material can be detachably retained to the frame. In one embodiment, the separate retaining means comprises a spring clip conforming to the inner surface of the frame to clamp the filter material along that surface. In another embodiment, the retaining means comprises a complementally configured frame which, for the sake of convenience in use, is pivotally attached to a manual support means extending from said frame and which coacts with the frame to retain the filter material during use.

Several embodiments of the filter are also shown in the present application. In one embodiment, the filter has a separate packet of charcoal impregnated material situated proximate to a plurality of breather holes.

Other additional embodiments of the present invention provide a novel trilateral elastomeric frame, which frame is constructed from a resilient pliable material which tapers to a feathered edge along the perimeter intended to contact the user's face. A transparent facial insert is retained in the elastomeric frame by means of the mating of a flange formed on the insert with a slot formed in the elastomeric frame. Generally, the body of the frame is quite deep, thereby allowing a gentle taper of the elastomeric material to the feathered edge, even at a point on the forehead engaging third side which has a depth at its minimum which is only 30–70% and preferably 50% of the maximum depth of the frame in the temple portions. This elastomeric frame also comprises a handle portion which is joined to the chin portion of the frame and which is spaced apart from the feathered edge by at least 30% of the total depth of that chin portion. The transparent facial insert forms a continuous inner surface with the sides and temple portions of the frame, and has removably mounted therein a filter means. The above-described mask is therefore particularly adapted for engagement with a transparent bag-shaped perforated sanitary web which envelopes the mask and is adapted to conform to the interior surfaces of the mask so as to allow the user to breathe freely. The novel perforated sanitary web of the present invention does not require additional retaining means, and acts to protect both the interior and exterior of the mask from contamination, either directly from the spray, or by reason of contact with the user's face. The user is likewise protected from directly contacting portions of the mask during its use. Since the perforated web of this embodiment is easy and inexpensive to fabricate, it is contemplated that it may be disposed after a single use. The disposable sanitary web of the present invention also acts to extend the life of the filter material by protecting the material from direct contact with the spray to be used.

Accordingly, it is an object of this invention to provide a new and novel face mask of a filtering and sanitary type which overcomes the aforementioned deficiencies of the prior art. This and other objects of my invention will become apparent from the following description with reference to the accompanying drawings.

BRIEF DESCRIPTION OF THE DRAWINGS

FIG. 7 is a perspective view taken from the front right side of an alternate embodiment device in accordance with my invention;

FIG. 8 is a left side view on an enlarged scale of the embodiment shown in FIG. 7, with an alternate position shown in phantom;

FIG. 9 is a section on an enlarged scale taken as indicated by the lines and arrows 9—9 shown in FIG. 7;

FIG. 10 is a section taken as indicated by the lines and arrows 10—10 in FIG. 8;

FIG. 13 is a perspective view taken from the left front side of a transparent filter material in accordance with one embodiment of my invention;

FIG. 14 is a foreshortened section on an enlarged scale taken as indicated by the lines and arrows 14—14 in FIG. 13;

FIG. 15 is a perspective view taken from the rear left side of a transparent filter material in accordance with another embodiment of my invention.

DESCRIPTION OF THE PREFERRED EMBODIMENTS

Figure 1:
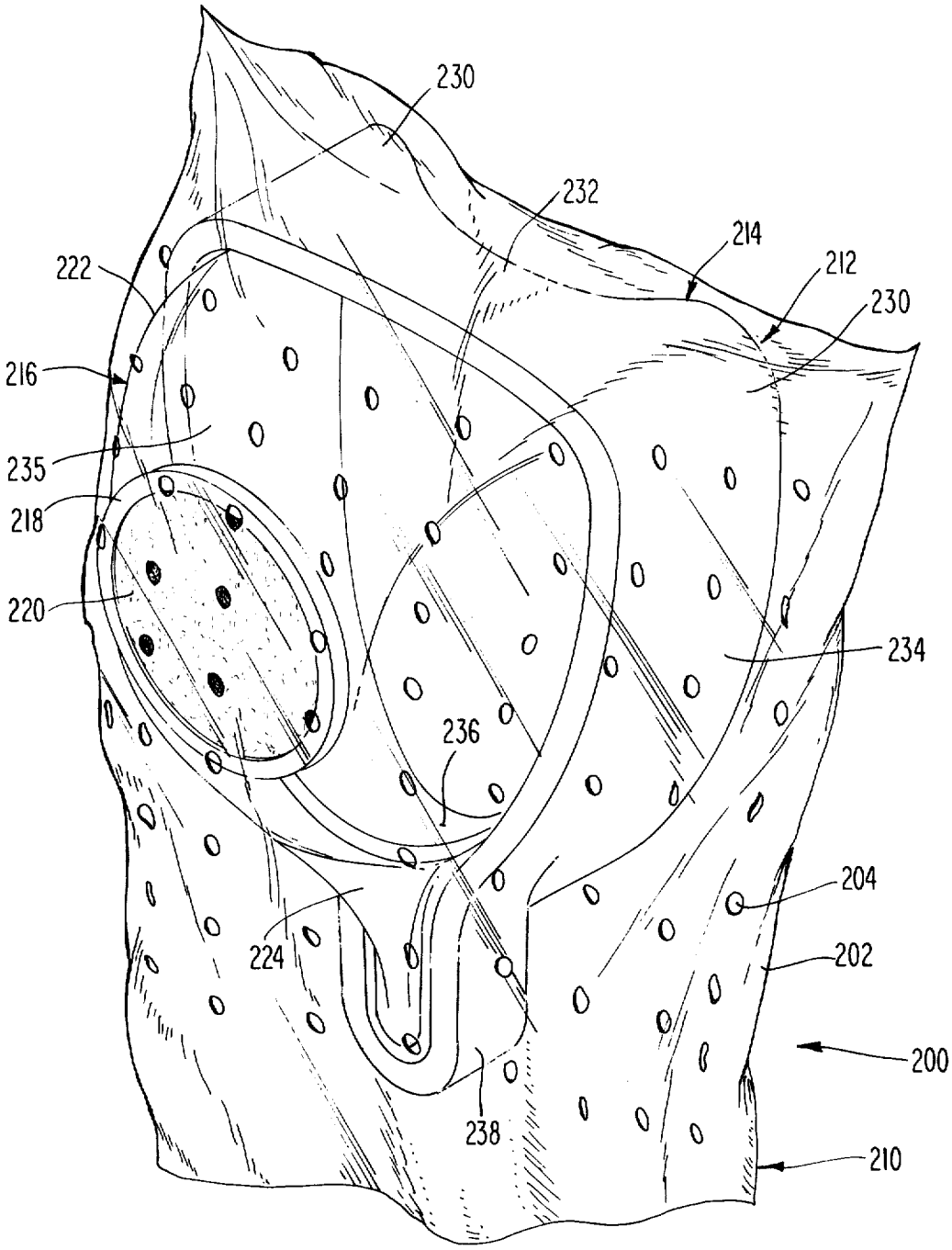
FIG. 1 is a perspective view taken from the front right side of a device in accordance with my invention.

Although specific forms of the invention have been selected for illustration in the drawings and the following description is drawn in specific terms for the purpose of describing these forms of the invention, this description is not intended to limit the scope of the invention which is defined in the appended claims.

Referring to the figures, various embodiments of my invention are shown wherein it will be noted that one embodiment of my invention comprises a frame means forming a hollow substantially semi-ovid with a parameter suitably contoured for a portion of the human face, and a separate flexible sheet material forming a transparent filter means positioned about the frame, preferably so that it overlaps the perimeter of the frame, in order to provide a sanitary disposable surface adjacent to the face of the person utilizing the device. FIGS. 7 – 10 show the basic frame 10 which consists of a lightweight plastic material suitably formed in the shape of a hollow semi-ovid with an outwardly extending flange 12 forming a perimeter. The exact contour of the perimeter or margin 12 is not critical for the present invention; it being known in the art to provide a facial contour as can be readily ascertained from the above referenced patents. In this embodiment, a handle 14 depends from the frame. Pivotally mounted to the bottom thereof by means of the pin 18 is a handle 20 of the retaining means 22. The handle portion 20 is complementally configured to the handle portion 14 and overlies it in the closed condition shown in FIGS. 7, 8 and 10. The retaining means 22 is a body complementally configured to the frame 10 so that it will fit together as shown. The specially designed sheet of material 24 is utilized for this embodiment of the present invention. Generally in this embodiment it consists of a plastic bag. It is preferably to have it transparent and it is most desirable to have it made of a material which is, in part, semi-permeable or foraminous, so that the material will pass air for breathing. Any suitable filter material available in sheet form which is sufficiently flexible can be used. Such filter material provides a means for filtering out the liquid particulate matter and toxic gases being sprayed into the air about the head of the user while still allowing the user to breathe normally. The material 24 can be a composite of plastic and paper or other similar materials. The porous portion can be made of a lightweight paper in which the charcoal dust or other particles having a similar function, have been implanted, so as to add to the purification of the air being breathed by the user. Further, the top half of the material may be a non-porous material, since only the bottom portion closest to the handle will be used in breathing. Thus, as in the examples illustrated in FIGS. 7–14, the top is a clear plastic and the bottom has a porous charcoal impregnated filter 26. In FIGS. 7 and 9, a separate sheet 28 of flexible plastic is attached to the material 24 to form an envelope for retaining the charcoal filter material 26. Any suitable means or methods can be used to attach the two pieces of plastic together as, for instance, by heat fusing or by adhesive. Both the separate sheet 28 and the sheet 24 are perforated by a plurality of holes clearly shown in the drawings, as for example, at 30, 32 and 34, so that air can be freely drawn through the mask and, in particular, through the filter material 26.

In a preferred form of this embodiment the material 24 is of such a size that the outer edge of the material extends outwardly beyond the parameter of the mask in its assembled condition, so that the mating mask and retaining means 22 help the material 24 retain its shape during use. Further, it ensures a sanitary surface against the face of the user. It will be noted in this regard that the device when fully assembled as in FIGS. 7, 8 and 9 provides the user with a mask entirely composed of sanitary, disposable material in that portion which is closest to the user's face. That is, no permanent portion of the device is in contact with the user's face. It will be seen from what has been disclosed that the invention provides a sanitary and air purifying face mask for use during spraying. In operation, a user, having been provided with a dispenser of prepared flexible filter sheets for use with the preferred embodiments described above, need only insert a sheet above the mask frame 10, close the handle portion 20 over the handle portion 14, and then spray while holding the protected margins of the mask against the face. Once spraying has been completed, the mask can be removed, the handles opened and the sheet material quickly disposed of.

Figure 11:
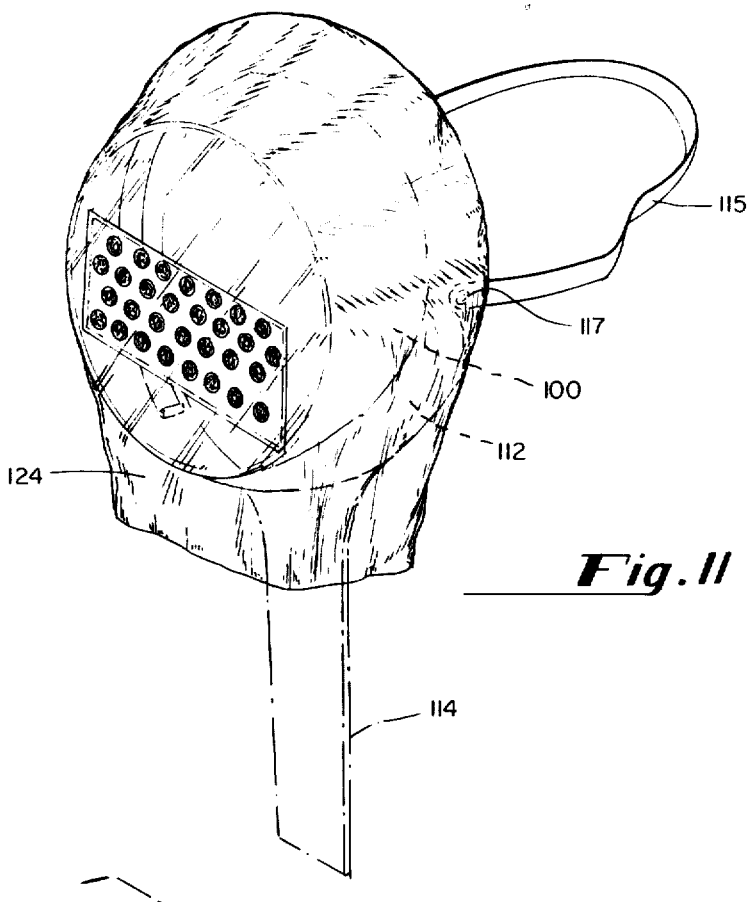
FIG. 11 is a perspective view taken from the front right side of another device in accordance with my invention with an alternate portion shown in phantom lines.
Figure 12:
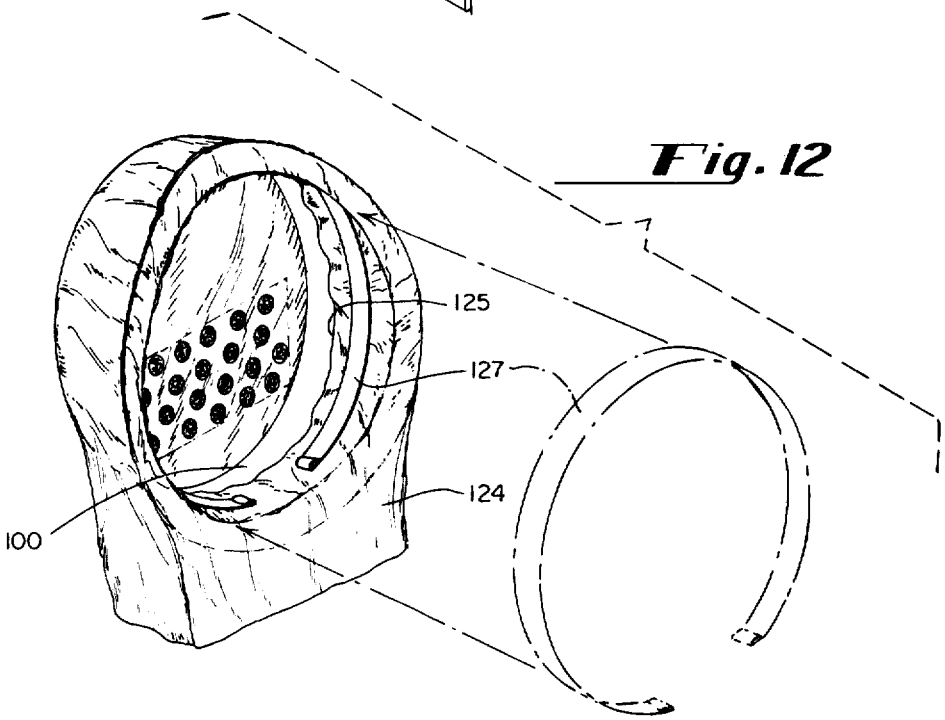
FIG. 12 is an exploded perspective view taken from the right rear side of the device shown in FIG. 11, with an alternate position of one part shown in phantom lines and with portions removed for the sake of clarity.

To make the use of this particular embodiment even more comfortable, I have provided a resilient material 38 along the margin 12. This resilient material can be foam rubber in a thin strip attached by adhesive to the plastic flange 12. It acts to cushion the force of the mask against the face of the user, and as a seal. FIGS. 11 and 12 show additional modifications to the basic invention. Herein, the frame 100 is identical to the frame 10 in FIGS. 7 and 8. However, instead of providing a manual support means in the form of a handle 14 as shown in FIG. 8, the manual support means 114 shown in phantom lines in FIG. 5 can be dispensed with. In order to hold the mask to the face of the user, a strap 115 is provided suitably attached at both ends by means of a rivet as, for example, shown at 117 in FIG. 11, to the outwardly extending margin 112 of Frame 100.

In either event, it will be noted that in the embodiment shown in FIGS. 11 and 12, the retaining means 22 is not utilized. Instead, the transparent filter bag 124 is modified in its construction and a separate retaining means is used to hold the bag to the frame 100. In particular, the bag has its inner surface cut out in a semi-ovoid hole (a portion of the periphery of which is designated as 125, FIG. 12) so that as the bag is positioned over the frame 100, the hole lines up with the hole in the frame. Sufficient material remains in the bag so that it extends inwardly along the inner surface of the frame 100 and is retained therein by means of the spring steel clip 127, FIG. 12, as clearly illustrated. Other than that modification, the bag is identical to the bag 24 previously described.

It will be understood that various changes in the details of construction could be made within the scope of this invention and, in particular, it should be clear that the handle 114 could be provided on the frame 100 if desired, instead of the strap 115.

A perspective view of the bag shown in FIGS. 11 and 12 is shown from the rear in FIG. 15. It will be understood from what has been said that such a bag could be used with various mask frames and/or with various retaining means, all within the scope of the present invention. A perspective view of the bag shown in FIGS. 7, 8 and 9 is shown in FIG. 13, taken from the front. A greatly enlarged section, which has been foreshortened for the sake of clarity, is shown in FIG. 14. It will be appreciated that this bag can also be used with various types of frames and/or retaining means for the same purposes and to achieve the same results as those disclosed and claimed herein.

Referring now to FIGS. 1–6, another alternate embodiment of the present invention is illustrated in which a mask having an elastomeric frame and a perforated sanitary bag are provided. Referring in particular to FIG. 1, which is a front right view of this embodiment of the present invention, the sanitary mask, designated generally 200, may be seen to comprise a perforated bag-shaped sanitary web designated generally 210, and a face mask, designated generally 212. The face mask may be seen to be completely enveloped by the web which, in the view shown in FIG. 1, has not been conformed to the interior of the mask as shown in phantom in FIG. 3, which configuration would be the preferred configuration for the web, designated generally 210, prior to its use. As seen in FIG. 1, the web is composed of a sheet of plastic material 202 having perforations defined therein.

The face mask designated generally 212 of this embodiment of the present invention is generally comprised of an elastomeric frame, designated generally 214, and a transparent facial insert, designated generally 216. As seen in FIG. 1, the elastomeric frame 214 is of a trilateral configuration formed from any suitable resilient material which is capable of satisfying the desired characteristics described herein. In particular, the elastomeric frame of this embodiment defines a perimeter which is suitably contoured for a portion of the human face. In particular, the elastomeric frame is comprised of three sides. The first and second sides 234 and 235 are adapted so that their peripheral edges will generally contact the cheek portions of a human face, whereas the third side 232 is generally contoured to conform to the forehead portion of a human face. The first and second sides 234 and 235 of the frame join in a curved chin portion which is designed to fit under the chin and to engage the submental or undersurface of the chin and to form a seal therewith. The third side 232 is joined to the first and second sides 234 and 235 at rounded temple portions 230 of the elastomeric frame. As seen in FIG. 1, the depth of the frame varies in order to produce a good seal between the face and the mask, which is accomplished in particular by providing a third side 232 which has a depth at its narrowest point which is between 30 and 70% of the maximum depth of the temple portions 230 of the frame. Ideally, it has been found that by providing a third side 232 which is, at its narrowest point, approximately 50% of the depth of the temple portion 230 of the frame an excellent seal is formed between the face and mask while maintaining excellent lateral shielding of the eyes from the spray.

Figure 2:
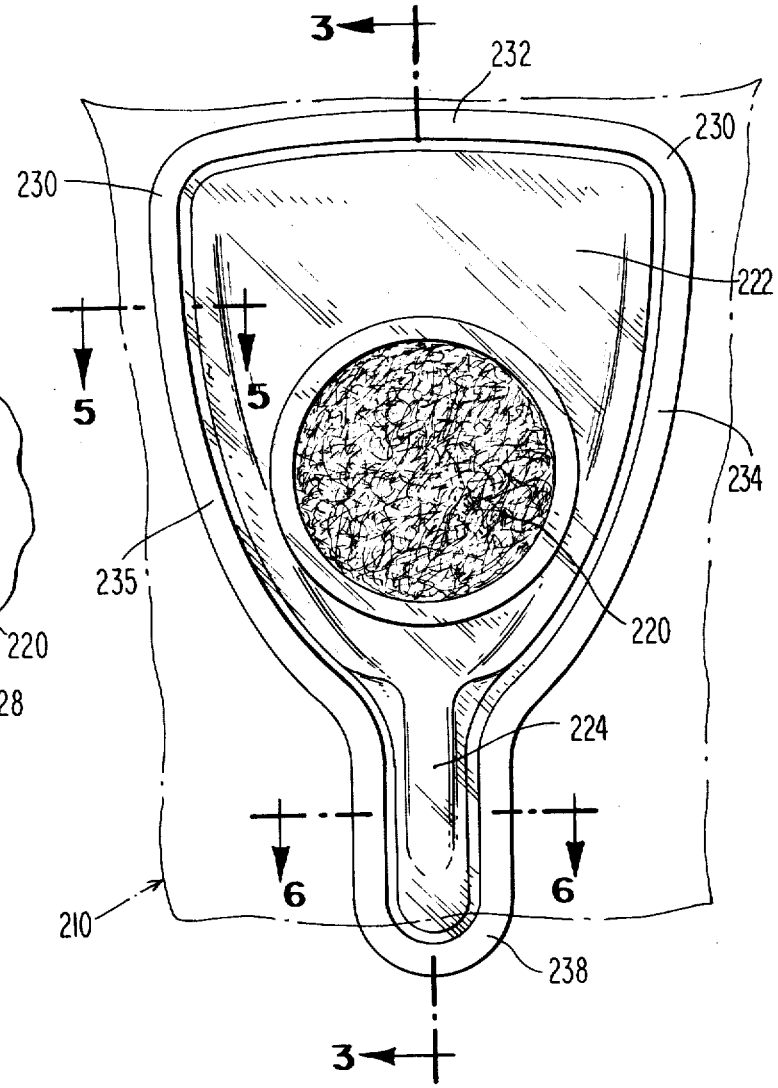
FIG. 2 is a front view of the embodiment shown in FIG. 1 with the sanitary web of the present invention being shown in phantom.

As also shown in FIG. 1, this embodiment of the present invention provides a transparent facial insert designated generally 216, which insert comprises a viewing portion 222, a handle strut 224, a filter retaining flange 218, a filter retaining lip 227 and removable filter material 220. Referring now to FIG. 2, which is a front view of the embodiment shown in FIG. 1 in which the positioning of the web 210 is shown in phantom, it may be seen that the third side 232 of the trilateral frame will meet the face on a line substantially parallel to the line of the eyebrows thereby leaving between that side and the filter material 220 a large domed viewing portion 222 in the transparent facial insert. Similarly, with respect to the third side 232, the temple portions of the frame may be seen to be rounded portions disposed at the intersection of the third wall 232 and the first and second walls 234 and 235, which portions are adapted to snugly fit against the temples of the user, and thereby, in conjunction with the side walls of the frame to shield the eyes from lateral contact with the particles and/or gases which are sprayed. The handle portion of the frame integrally formed with the remainder of the frame is seen in FIG. 2 to join at the chin portion at the intersection of the first and second walls 234 and 235. Located over the handle portion 238 is the handle strut 224 which is formed in the facial insert in order to provide additional rigidity to the handle portion 238. Therefore, the manual support means for this embodiment of the present invention comprises the handle portion 238 and handle strut 224.

Figure 3:
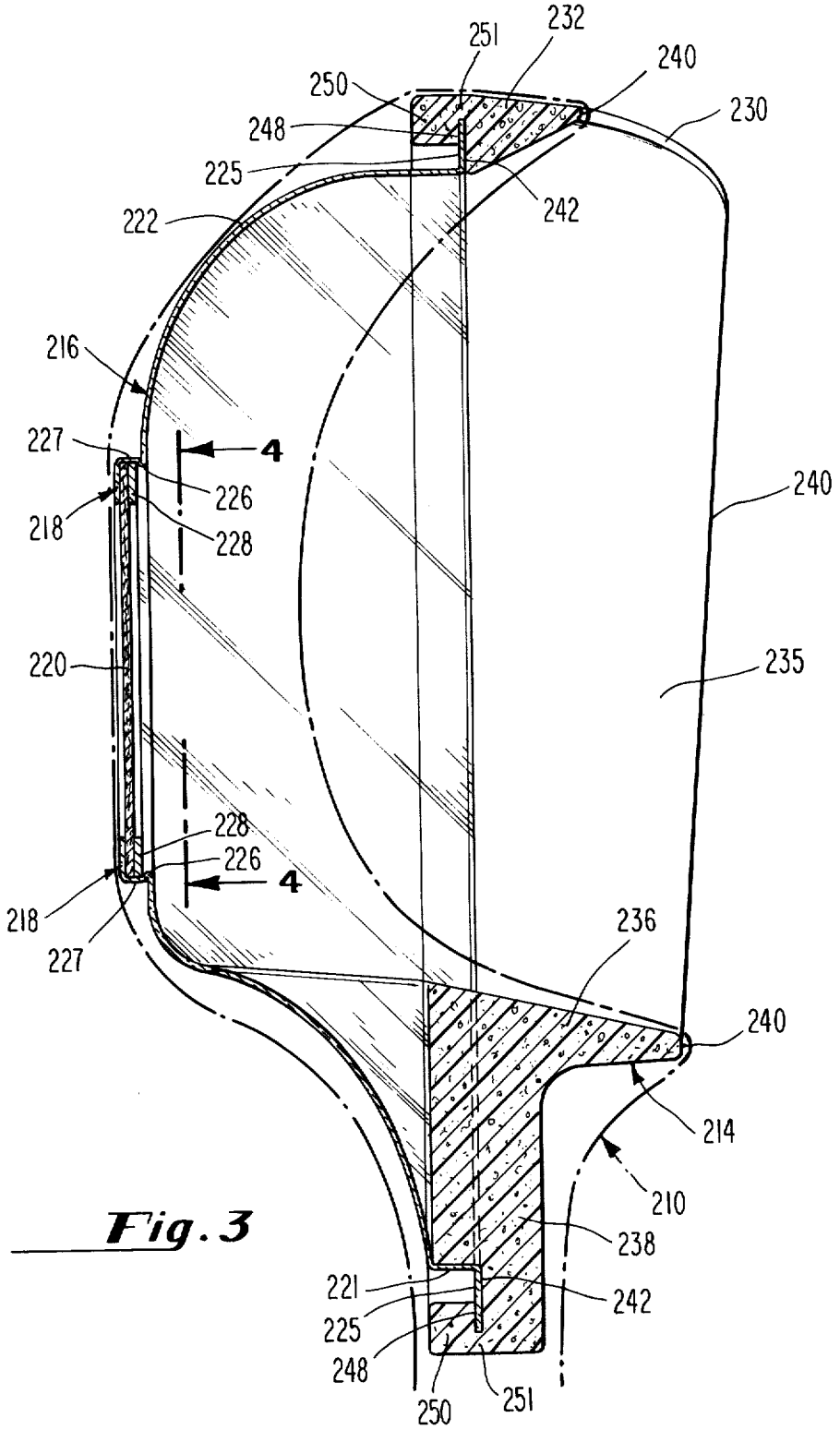
FIG. 3 is an enlarged cross section of the embodiment shown in FIG. 2 taken as indicated by the lines and arrows 3—3.

Referring now to FIG. 3, the handle strut 224 may be seen to be positioned with respect to the handle portion so that it is grasped mainly by the base of the forefinger which comfortably presses the handle portion 238 into the palm of the hand, while at the same time providing a positive manual support means for bringing the mask into positive engagement with the face. As may be seen in FIG. 3, the operating configuration of the mask as engaged by the perforated bag-shaped sanitary web 210 is clearly shown. Due to the unique structure of the body portion of the mask, the perforated sanitary web may be easily slipped over the top of the mask and down over the handle portion 238 as shown in FIG. 3. The portion of the web which extends over the back of the mask is then manually pushed into the dome shaped recess which is defined by the frame 214 and the transparent facial insert designated generally 216. The perforated sanitary web designated generally 210 is preferably a flat bag having corners which generally will conform to the temple portions 230 of the frame and which, thereby, aid to retain the web in the configuration shown in phantom in FIG. 3. It is therefore possible in this embodiment of the present invention to entirely dispense with auxiliary retaining means for the sanitary web. As in other embodiments of the present invention, all portions of the device which are likely to come into direct contact with the skin of the user are effectively shielded, however unlike most of the other embodiments, no separate retaining means are necessary in order to keep the web in its desired position. This feature is made possible not only by the configuration of the bag-shaped web 210, but also in particular by the extreme depth (at least 1 inch and preferably ≧ 2 inches maximum) of the resilient elastomeric frame and the depth of the dome shaped transparent facial insert designated generally 216 (also at least 1 inch and preferably ≧ a 2 inches maximum) which allow the web to be pushed sufficiently far away from the face of the user to virtually eliminate any likelihood that the plastic material which comprises the web would be disturbed by the breathing of the user.

The relative depth of the elastomeric frame designated generally 214 of the present invention also gives rise to certain other important advantages. In particular, the width of the frame, as defined along the line which bisects the taper of the frame to the feathered edge, may be seen to provide the additional advantage of allowing the handle portion 238 to be set away from the feathered edge 240 of the chin portion 236. Since the chin portion is intended to engage the submental area of the face, and because the various dimensions and configurations of that area will vary from user to user, it is important to provide an elastomeric frame having sufficient depth to retain the flexibility required in that portion of the elastomeric frame which is adjacent to the feathered edge 240. In the preferred embodiment shown in FIG. 3, this handle portion has a depth which is approximately 45% of the total depth of the chin portion 236, however it is contemplated that this handle portion 238 might comprise up to 70% of the total depth of the chin portion, while retaining the characteristic flexibility required for positive submental engagement of the chin portion and feathered edge with this desired facial area.

Also seen in FIG. 3 extending upwardly at an acute angle with respect to the handle portion 238 is the second side 235 which is intended to engage the cheek portion of the face extending from the temples to the submental portion of the face. The second side 235 similarly terminates in a feathered edge which provides great adaptability to the various facial configurations of the intended users of the device. In particular, it may be seen that the depth of the elastomeric frame designated generally 214 is greatest at the temple 230 (preferably ≧ a 1.5 inch maximum) which portion, at its intersection with the side 235 is particularly adapted for laterally shielding the eyes from contacting particulates contained within the spray. This lateral shielding is accomplished, at least in part, by the reduced depth of the third side 232 which is conformed to the forehead of the intended user. As shown in FIG. 3, the forehead portion has a depth of approximately 50% of the maximum depth of the temple portion 230. By also being configured to taper to a feathered edge 240, this forehead portion similarly retains a resilience which aids in the formation of a seal along the face of the user. Although the preferred depth of this third side at its narrowest point is approximately 50% of the maximum width of the temple portion 230, it is contemplated that this side may reach a minimum which is from between 30 and 70% of the maximum depth of the temple portion while still retaining the desired characteristics which are in accordance with the objects of the present invention.

Also shown clearly in FIG. 3 is the interengagement of the transparent facial insert designated generally 216 and the elastomeric frame designated generally 214 of the present invention. Referring now to the point of intersection on the handle portion 238, it may be seen that a flange 225 is defined along the frame engaging perimeter of the transparent facial insert designated generally 216. This flange is adapted to mate, at least in part, with a slot 248 which is defined in the elastomeric frame designated generally 214. This slot, as formed in the handle portion 238 tends to segment a portion of the frame to form an elastomeric lip 250 around an entire perimeter of the frame. This lip 250 is attached to the remainder of the frame by a connecting area 251 which, during assembly, acts as a hinge which allows the elastomeric lip 250 to be bent outwardly to allow for the introduction of the flange 225, into the slot 248.

An additional feature of the interconnection between the transparent facial insert designated generally 216 and the elastomeric frame designated generally 214 is the novel ledge 242 which is also provided to engage the flange 225. This ledge serves a double purpose, first an additional supporting area for the flange is provided which tends to resist any tendency of the transparent facial insert designated generally 216 to collapse towards the wearer's face. Secondly, adequate support for the flange 225 is provided with a savings in the material and an increased assembling efficiency which is accomplished by opening a recess defined above the ledge 242 which has the dual advantage of providing an elastomeric lip 250 with the hinging characteristics described above.

Referring again to the third side 232 which is adapted to conform to the forehead portion of the user, it may be seen that the elastomeric lip 250, the slot 248, the ledge 242 and the connecting area 232 extend around an entire periphery of the elastomeric frame designated generally 214. Furthermore, each side and the temple portions of the elastomeric frame designated generally 214 have inner surfaces 244 which are generally continuous with the inner surface of the transparent facial insert 222. This is an important feature since the possibility of the sanitary web designated generally 210 catching on the transparent facial insert either during insertion or removal is virtually eliminated. Furthermore, a smooth inner surface tends to discourage the buildup of dirt which might prove unsanitary to the mask.

Figure 4:
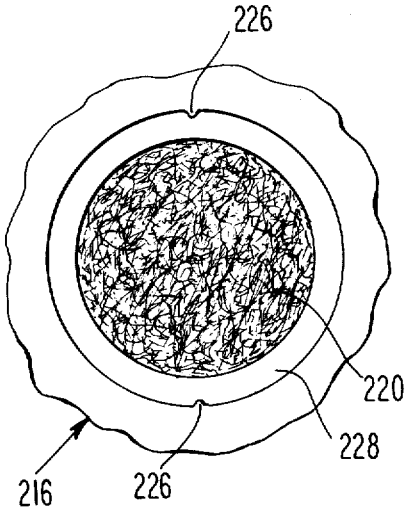
FIG. 4 is a cut away back view of the filter means of the embodiment shown in FIG. 3 taken as indicated along the lines and arrows 4—4 in FIG. 3.
Figure 5:
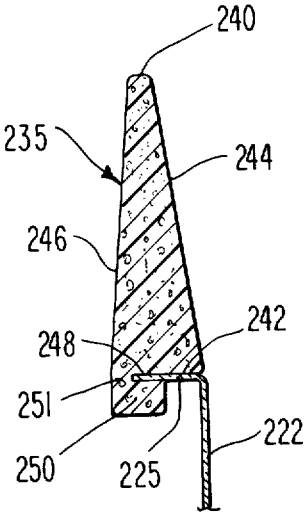
FIG. 5 is a cross section of the elastomeric frame and a portion of the transparent facial insert taken as indicated by the lines and arrows 5—5 in FIG. 2.
Figure 6:
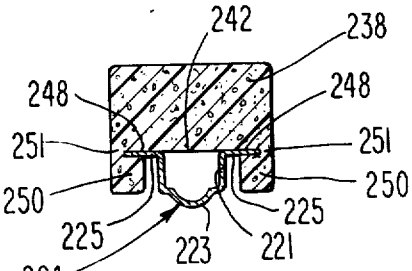
FIG. 6 is a section of the manual support means of the embodiment shown in FIG. 2 taken as indicated by the lines and arrows 6—6 in FIG. 2.

Referring now to FIG. 4, the filter means of the present invention is shown comprising the filter material 220, the filter retaining ring 228, filter retaining lips 226 which are fitted into a portion of the transparent facial insert designated generally 216, which has been cut away in FIG. 4. Referring again to FIG. 3 showing a cross section of the filter means disposed within the transparent facial insert, it may be seen that the filter retaining ring 228 engages the peripheral edges of the filter material 220 against a filter retaining flange 218 which is formed in the transparent facial mask designated generally 216. This filter retaining flange is offset from the plane of the viewing portion of the facial insert 222 which is adjacent thereto by a filter retaining lip which is a substantially cylindrical projection of a sufficient depth to allow for the recessing of the filter means in the facial insert. Generally, the retaining ring 228 is composed of a fiberous material which is slightly deformable and which is manufactured to engage the inner surfaces of the filter retaining lip 227. Filter retaining points 226 are provided to ensure that the filter retaining ring 228 does not separate from its engagement with the filter material. These filter retaining points 226 which are located at opposite sides of the filter means are small dimples which are formed in the facial insert at the intersection of the filter retaining lip 227 and the body of the facial insert. These dimples are therefore slight deformable projections which enable the filter retaining ring 228 to easily be snapped in and out of the retaining position shown in FIG. 3. Consequently, the filter material may easily be removed and replaced when it has become sufficiently contaminated to be undesirable for use with the mask. It should be noted from FIG. 3 that this filter material 220 is enveloped by the perforated bag-shaped sanitary web of the present invention designated generally 210 in such a manner as to allow for the free passage of atmospheric air into the mask while at the same time protecting the preponderence of the filter material from being directly sprayed. Referring now to FIG. 5 which represents a section through side wall 235 including a portion of the transparent facial insert viewing portion 222, the smooth taper of the wall may be seen terminating in the feathered edge which comprises the perimeter of the mask which is to engage the face of the user through the sanitary web described above. The inner surface 244 of the side wall may be seen to be substantially continuous with the inner surface of the viewing portion 222 of the transparent facial insert. The outer surface 246 of the side wall may be seen to terminate at the feathered edge 240 and at the tip of the elastomeric lip 250. The connecting area 251, slot 248, elastomeric lip 250, flange 225 and ledge 242 are also clearly shown in FIG. 5. Referring now to FIG. 6, which is a section taken through a portion of the handle, it may be seen that the handle portion 238 of the frame has defined therein slots 248 which are located on opposite sides of the upper area of the handle portion 238. The ledge 242 is of enlarged area in the handle and together the ledge 242, the slots 248, the connecting areas 251 and the elastomeric lips 250 comprise track means which engage the two flange surfaces 225 of the transparent facial insert under the strut portion designated generally 224. Therefore, during the assembly of the mask of the present invention the facial insert designated generally 216 and particularly the handle strut portion of the facial insert designated generally 224 is introduced into engagement with the handle portion 238 of the frame by inserting the portion of the flange 225 which is at the tip of the handle strut designated generally 224 into the grooves on the handle portion in the vicinity of the intersection of the handle portion 238 with the chin portion 236 of the frame. The flanges may then be slid down the track means for engaging the handle strut 224 of the present invention until all the flange surfaces are engaged by the slot 248 disposed about the perimeter of the handle portion 238. Once the handle strut is inserted into the handle portion by way of this above described track means, the remaining portion of the flange which encircles the transparent facial insert may then be fitted into the slot under the elastomeric lip 250 in the manner described above.

It will also be noted from FIG. 6 that the handle strut designated generally 224 is additionally comprised of strut walls 221 which extend for a distance which is approximately equal to the width of the elastomeric lip 250, and a strut dome 223 which may be seen in FIG. 3 as extending in a generally angular fashion to meet the face of the transparent facial insert to form a supporting strut of unusual strength.

It will be understood that various changes in the details, materials and arrange of parts which have been described and illustrated in order to explain the nature of this invention, may be made by those skilled in the art within the principle and scope of the invention as expressed in the appended claims.

It will further be understood that the Abstract of the Disclosure set forth above is intended to provide a nonlegal technical statement of the contents of the disclosure in compliance with the Rules of Practice of the U.S. Patent Office, and is not intended to limit the scope of the invention described and claimed herein.

I claim:

1. In a sanitary face mask having a transparent facial insert for shielding at least the eyes, nose and mouth of the user, the improvement wherein said mask further comprises a tri-lateral elastomeric frame having a first perimeter, and a second perimeter spaced apart from the first perimeter and providing substantial depth to said frame, said frame comprising first and second sides of equal length which join in a curved bottom portion, said second perimeter substantially parallel to said first perimeter along said first and second sides, said bottom portion providing a means for positively locating said mask during use whereby said bottom portion engages the underside of the chin of said user, said frame further comprising a third side, which joins with said first and second sides of said frame to form the top portion of said frame which is spaced apart from said bottom portion, said sides of said frame forming a taper which terminates in a continuous feathered edge along said first perimeter, said third side having a depth of concave shape which, at its smallest point, is between 30 and 70 percent of the maximum depth of said first side, said frame further including handle portion comprised of a lateral extension of said frame, said handle portion for manually supporting said mask, said handle portion joining said bottom portion, said handle portion being spaced apart from said first perimeter by at least 30 percent of the depth of said bottom portion and said first, second and third sides being of one-piece construction.

2. The invention of claim 1 wherein the depth of said third side at its smallest point is 50 percent of the maximum depth of said first side.

3. The invention of claim 1 wherein said face mask further comprises a disposable perforated bag-shaped web for enclosing said face mask along said first and second perimeters.

* * * * *